US006083233A

United States Patent [19]

Kreutz et al.

[11] Patent Number: 6,083,233

[45] Date of Patent: Jul. 4, 2000

[54] APPLIANCE FOR PLUCKING HAIRS OUT OF HUMAN SKIN

[75] Inventors: Norbert Kreutz; Pedro Sanchez-Martinez, both of Kronberg, Germany; Richard Cohen, Gaithersburg, Md.; Dietrich Pahl, Hofheim, Germany

[73] Assignee: Braun Aktiengesellschaft, Kronberg, Germany

[21] Appl. No.: 08/996,991

[22] Filed: Dec. 12, 1997

Related U.S. Application Data

[63] Continuation of application No. PCT/EP96/02412, Jun. 4, 1996.

[30] Foreign Application Priority Data

Jun. 14, 1995 [DE] Germany ..... 195 21 585

[51] Int. Cl.[7] ..... A61B 17/50

[52] U.S. Cl. ..... 606/133; 606/131

[58] Field of Search ..... 606/131, 133; 452/83, 84, 88, 75, 102, 104, 100, 101

[56] References Cited

U.S. PATENT DOCUMENTS

| | | | |
|---|---|---|---|
| 5,084,056 | 1/1992 | Eckel et al. | 606/133 |
| 5,197,969 | 3/1993 | Visscher et al. | 606/133 |
| 5,346,499 | 9/1994 | Garenfeld et al. | 606/133 |
| 5,810,843 | 9/1998 | Iwasaki et al. | 606/131 |
| 5,893,854 | 4/1999 | Bontoux et al. | 606/133 |
| 5,916,222 | 6/1999 | Iwasaki et al. | 606/133 |

FOREIGN PATENT DOCUMENTS

| | | |
|---|---|---|
| 0 287 976 A2 | 10/1988 | European Pat. Off. . |
| 0 386 327 A2 | 9/1990 | European Pat. Off. . |
| 0 493 849 A1 | 7/1992 | European Pat. Off. . |
| 0 596 283 A1 | 5/1994 | European Pat. Off. . |
| 0 760219 A1 | 3/1997 | European Pat. Off. . |
| 0 795283 A1 | 9/1997 | European Pat. Off. . |
| 0 807388 A1 | 11/1997 | European Pat. Off. . |
| 44 08 809 C1 | 6/1995 | Germany . |
| WO 95/07638 | 9/1990 | WIPO . |
| WO 97/19613 | 6/1997 | WIPO . |

OTHER PUBLICATIONS

JP4126103, Publihed Apr. 27, 1992, Patent Abstracts of Japan (vol. 16, No. 387 (C–0975)).

JP8140726, Published Jun. 4, 1996, WPI/Derwent Patent Abstract, Week 9632.

*Primary Examiner*—Glenn K. Dawson
*Attorney, Agent, or Firm*—Edward S. Podszus

[57] ABSTRACT

The invention is directed to an appliance for the epilation of the human skin, having a housing to accommodate a motor and a drive mechanism for driving at least one clamping device (43) by which the user's hairs can be extracted. Moreover, a stimulus mechanism is provided to reduce the sense of pain during epilation. This mechanism includes at least one element (55) that is movable toward and away from the skin when the appliance is placed in epilating position on the user's skin. According to certain embodiments of the present invention, the at least one element (55) has a free end (56) and is arranged adjacent to the side of the rotary clamping device (43). In consequence, the user perceives at least subjectively a reduced sense of pain during epilation. Still further, a method for epilation and a method for the use of the appliance of the present invention are described.

65 Claims, 8 Drawing Sheets

Fig. 3a
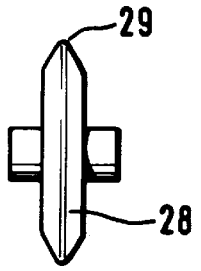
Fig. 3b
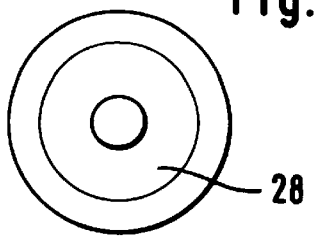
Fig. 3
Fig. 4a
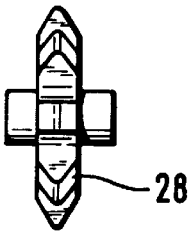
Fig. 4b
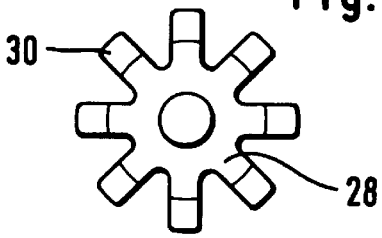
Fig. 4
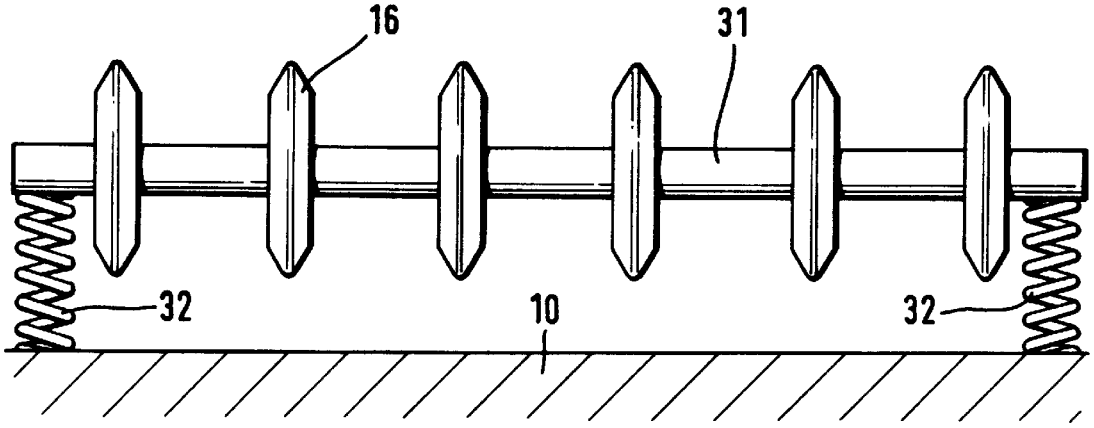
Fig. 5

35
36
6

6
35
10

36
35

Fig. 9a
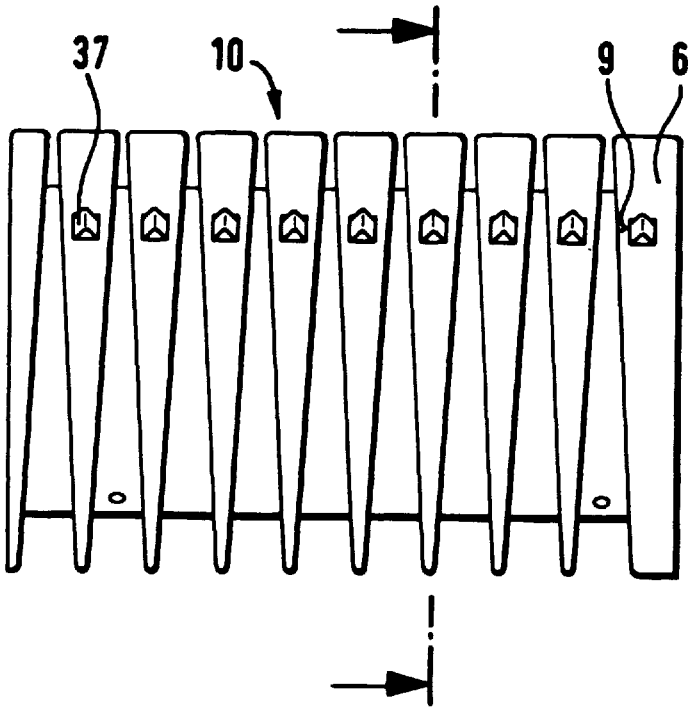
Fig. 9c
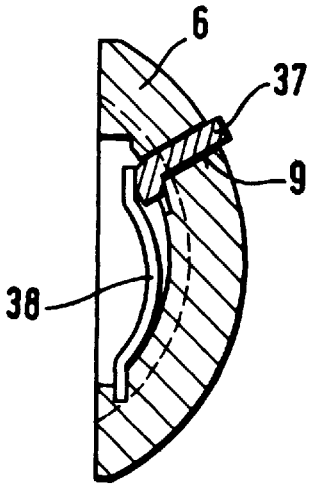
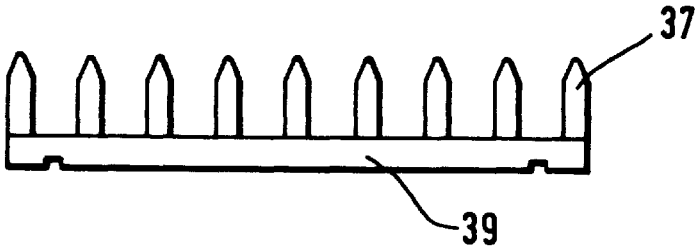
Fig. 9b
Fig. 9

APPLIANCE FOR PLUCKING HAIRS OUT OF HUMAN SKIN

This application is a continuation of International Application No. PCT/EP96/02412, pending, filed on Jun. 4, 1996.

BACKGROUND OF THE INVENTION

This invention relates to an appliance for the epilation of the human skin, having a housing to accommodate a motor for driving at least one clamping device rotary about an axis for epilation, and having a means to reduce the sense of pain during epilation, said means including at least one element that is movable toward and away from the skin when the appliance is placed in epilating position on the user's skin. The invention relates in addition to a method for the epilation of the human skin.

An epilating appliance of this type and a related method of epilation are known from European patent application No. EP 493 849 A1. According to this patent application, the hairs are continuously entrapped and extracted by counter-rotating rollers. In front of the rollers are webs which lie flat on the skin during use and jointly perform a vibrating reciprocating movement. The frequency of this vibration can lie between 5 hertz and 1000 hertz. During use of the epilating appliance the vibrations of the webs engaging the user's skin are intended to produce a pain that overshadows the pain caused by the epilation. This should result at least subjectively in a reduction of the user's sense of pain caused by the actual epilation. In practice, however, it has shown that the actual stinging pain caused by the epilation is still perceived and felt as unpleasant by the user in spite of the use of these vibrating webs engaging the skin.

An epilating appliance according to the non prior published German patent application No. P 44 08 809 has a rotary cylinder with clamping devices that enable the cyclic entrapment and extraction of hairs. Provision is made furthermore for two electrodes enabling a stimulating current to be emitted to the skin. This enables stimulation of the underlying nerve structures, resulting in the at least subjective impression of a reduction of pain for the user.

SUMMARY OF THE INVENTION

It is an object of the present invention to provide an appliance and a method for the epilation of human skin as well as a method for using the appliance, whereby the epilation is performed more effectively and with the greatest possible reduction of the user's sense of pain.

According to the present invention, this object is achieved in an epilation appliance and in a method wherein by reason of the fact that at least one element that is movable toward and away from the skin has one free end, a mechanical pulse can be generated to advantage, producing a stimulation on the skin which overshadows the actual pain during epilation. Furthermore, by arranging the at least one element, but in particular several elements, adjacent to the side of the rotary clamping device, the stimulation on the skin occurs advantageously before or during the epilating operation.

The pulse emitted before or during the actual epilating operation simulates artificially the pain otherwise caused by the epilation, being preferably of less intensity but having essentially the same pain characteristic, so that it overshadows or anticipates the actual pain. Because of the reduced intensity the additional pain is not felt by the user to be as disagreeable as the actual stinging pain caused by the actual epilation. On the contrary, practical tests have revealed that users of the epilating appliance hardly feel the actual stinging pain any longer as the result of the preceding pulse, but that instead they notice essentially only the far more agreeable stimulation caused by the respective pulse. This is probably owed to the fact that the nerve cells are practically paralyzed temporarily by the stimulation caused by the pulse and hence are insensitive to pain so that the actual stinging pain caused by the epilation is largely subdued, meaning that the user does not notice it at all or only to a weakened degree. On the whole, therefore, the pulse results in the user either not feeling or hardly feeling the actual stinging pain during epilation so that the sense of pain is substantially reduced.

The appliance and the method are optimized by delivering the pulse against or onto the skin directly before either the time or place or the time and place of the particular individual epilating operation because in this way the nerve cells that are about to be activated by the directly imminent epilating operation will be temporarily deadened or deactivated, so to speak, by the pulse performed ahead of the epilation in time and/or place.

In an advantageous embodiment of the present invention, the element is associated with the clamping device so as to be rotary about the axis thereof. Hence the element is set in rotation directly with the clamping device. There is no need, therefore, for any special components to drive the element.

In an advantageous further feature of the present invention, the element is movable toward and away from the skin. The pulse is thereby obtained mechanically in simple manner by the reciprocating movement of the element. This requires few additional components and therefore little extra manufacturing effort.

In an advantageous further feature of the present invention, the element is movable from a retracted position into an advanced position and hence into contact with the skin directly before epilation. This movement produces the desired pulse and hence the artificial pain in the skin. It is an advantage for this movement to be performed as close as possible to the epilation, and for the type and manner of the movement, particularly its acceleration and speed, to occur in the manner of a pulse. The pulse serves to create an artificial, weak pain that overshadows the actual stinging pain caused directly afterwards by the epilation and reduces the user's perception of this pain at least subjectively.

In an advantageous further feature of the present invention, the element is movable into the advanced position directly after the pulse is delivered to the skin. This ensures that the element is back in its starting position for the next epilating operation and able to trigger a new pulse onto the skin. The desired artificial pain is thus created by the pulse without this having any other adverse effects on the user.

According to the present invention it is particularly suitable for the element to be able to be urged back into the retracted position by the skin itself. This arrangement does not require any special components or the like. Instead, the element recedes automatically while delivering a pulse against or onto the skin as soon as it reaches the skin. It is an advantage for each individual clamping device of the appliance to be assigned one element for delivering a pulse. This approach represents an independent feature of the present invention.

In an advantageous aspect of the present invention in which the clamping device is able to perform a rotary movement with cyclic epilation, the element is coupled with the rotary movement of the clamping device and is arranged directly ahead of the clamping device viewed in the direction of rotation. In this simple way the element always delivers a pulse directly ahead of the time and position of each cyclic epilation by the clamping device. This is thus accomplished without any special additional components simply by the advantageous arrangement of the element in front of the clamping device viewed in the direction of rotation.

In an advantageous further feature of the present invention, the element is capable of adopting a retracted position which during a rotary movement has a diameter smaller than the maximum diameter of the clamping device, and an advanced position which during a rotary movement has a diameter greater than the maximum diameter of the clamping device. Hence during a rotary movement the element protrudes beyond the clamping device in its advanced position but not in its retracted position.

Particularly suitably, these two positions of the element are utilized for the following possible ways of generating pulses. A first possibility entails using the advanced position as a starting position and moving the element into its retracted position on striking the skin. The striking of the skin by the element represents the delivery of the pulse. Subsequently, the element is returned to its advanced position. A second possibility entails using the retracted position as a starting position and moving the element in the manner of a pulse into its advanced position directly before epilation. The desired pulse is thus produced and delivered to the skin by simple means. Subsequently, the element is returned to its retracted position. However, it will be appreciated that further possibilities of using the two positions of the element for the generation of pulses may be contemplated in the art.

In practice it has proven to be particularly suitable for the advanced position during a rotary movement to have a diameter which exceeds the maximum diameter of the clamping device by a value of between about 0.1 mm and about 6 mm.

In an advantageous aspect of the present invention, the element is movable by means of centrifugal force and/or spring force and/or cam tracks or the like. The reciprocating movement of the element between its retracted position and its advanced position is thus accomplished by simple means. A very precise control of the reciprocating movement of the element is accomplished in particular by the use of cam tracks.

In a further advantageous aspect of the present invention, the element has a pointed and/or a toothed and/or a bristled wheel and/or an accordingly formed roller or the like. This configuration has proven to be particularly advantageous in practice in particular for the above-described first possibility of producing pulses. In this case a toothed wheel, for example, is moved in the manner of a pulse from its retracted position to its advanced position with the aid of a cam track directly before epilation.

In another advantageous aspect of the present invention, the element has a protuberance and/or a point or the like and is resiliently coupled with the rotary cylinder. This configuration has proven to be particularly advantageous in practice in particular for the above-described second possibility of producing pulses. In this case the protuberance, for example, strikes the skin and creates the desired pulse following which it is urged back again by the skin from its advanced position into its retracted position.

In this connection it is particularly suitable in accordance with the present invention for the protuberance or the point or the like to be mounted on a threading device for the hairs awaiting extraction.

In another advantageous embodiment of the present invention, the element performs an essentially rectilinear movement. Consequently, when the element strikes the skin it causes particularly good stimulation of the nerves. The essentially rectilinear movement of the element produces a pulse that is particularly well suited to create an artificial pain and hence overshadow the subsequent pain caused by epilation. A further advantage of the element's rectilinear movement is that such a movement can be produced and controlled easily but nevertheless exactly.

In an advantageous further aspect of the present invention, the element is lowered onto the skin in particular directly before or else during epilation and is lifted from the skin in particular directly upon striking the skin. This sequence of movements for the element has proven to be particularly suitable in practice. It ensures in particular that the pulse triggered by the element is very short and occurs invariably before or during epilation.

In an advantageous further feature of the present invention, the processes of lowering the element onto the skin and lifting the element from the skin are controlled by mechanical means. In this manner it is possible, therefore, to control the movement of the element exactly but nevertheless simply and economically.

In an advantageous further feature of the present invention, the element is coupled with the clamping device for control purposes. This also facilitates the control of the element. Furthermore, this coupling is a simple and economical way to drive the element.

In an advantageous further feature of the present invention, the element is of a ram-type configuration and has a point which strikes the skin. In this feature the element is therefore a simple, elongate component which in particular on account of its point is particularly well suited to produce the desired pulse and hence pain upon striking the skin.

In an advantageous further feature of the present invention, the element is associated with a drive shaft that operates to lower the element into contact with the skin and lift it off again. The movement of the element is generated and controlled simultaneously by means of the drive shaft. Conveniently, the drive shaft is thus assigned a dual function. This simplifies the entire construction of the element's drive and control mechanism and has a positive impact on manufacture and related costs.

In an advantageous further feature of the present invention, the drive shaft is configured in the manner of a crank and is coupled with the element. The element's drive and control mechanism is materially simplified in particular by construction of the drive shaft in the form of a crankshaft. Particularly suitably, the element includes a guide in which the drive shaft engages. Simple yet effective coupling of the element with the drive shaft is thus achieved.

In an advantageous further feature of the present invention, provision is made for gears, bevel gears or the like to establish connection between the drive shaft and the clamping device. These types of connection represent simple yet effective possibilities of coupling the drive shaft with the clamping device. Hence the element as a whole is coupled with the clamping device on the one hand via the gears or bevel gears or the like and, on the other hand, via the element's guide, which engages in the crank-type drive shaft. By this means the element is driven and controlled by the clamping device via the drive shaft.

In an advantageous further feature of the present invention, a plurality of elements are in juxtaposed arrangement approximately parallel to each other. Suitable elements can thus be provided across the full width of the clamping device, enabling corresponding pulses for reducing the pain to be produced wherever epilation takes place.

In this connection it is particularly suitable for the drive shaft to be arranged approximately parallel to the axis of the clamping device. This arrangement facilitates the coupling of the drive shaft with the clamping device, in addition to being advantageous with a view to the arrangement of the element or elements driven and controlled by the drive shaft.

In further advantageous features of the present invention, the element or elements are mounted for displacement in the longitudinal direction, and/or the drive shaft is rotatably mounted on the housing.

In an advantageous further feature of the present invention, the element delivers a mechanical pulse and/or an electrical pulse. The particular advantage of the mechanical pulse is that the element can be manufactured in a simple and economical way. Furthermore, this type of pulse generation is easy to understand by the user, which is an advantage for the user's acceptance of innovations. The advantage of the electrical pulse is that there is customarily no need for any moving components and that the pulse can be controlled easily by conventional electronic means.

Particularly suitably, the electrical pulse is generated on the epilating appliance of German patent application No. P 44 08 809 initially referred to by controlling the stimulating current in dependence upon the cyclic epilation, particularly by emitting a stimulating current in the manner of a pulse, in particular ahead of the place and/or time of each cyclic epilating operation.

In a particular further feature of the present invention, which can represent an independent solution to the object of the present invention, a method for the epilation of the human skin is proposed, in which a mechanical pulse is delivered to the user's skin by means of at least one element coupled with the drive mechanism of a clamping device for epilation, which pulse causes the user either not to feel the actual pain of the epilation or to feel it only as a pain of lower amplitude. Advantageously, the skin is struck with a free end of the at least one element which is arranged adjacent to the side of the rotary clamping device. On the one hand this results in the free end producing a stimulation on the skin that overshadows or at least reduces the pain of epilation. On the other hand the arrangement of the at least one element adjacent to the side of the rotary cylinder has the effect of enabling the stimulation to be generated on the skin ahead of the time and/or place of the epilating operation or during it. It is thus possible advantageously to effectively reduce the pain of epilation.

A method for the use of an appliance in accordance with the present invention is also proposed. This method entails placing the appliance on the user's skin to be treated and moving it over the skin in such a way that the means for reducing the sense of pain, in particular the free end of the at least one element, precedes the rotary clamping device for epilation viewed in the direction of movement. An advantageous application of the appliance enabling an effective reduction of the actual pain of epilation is thus provided.

Further features, advantages and application possibilities of the present invention will become apparent from the subsequent description of embodiments illustrated in more detail in the accompanying drawings. It will be understood that any single feature and any meaningful combination of single features described and/or represented by illustration form the subject matter of the present invention, irrespective of their summary in the claims or their back-reference.

BRIEF DESCRIPTION OF THE FIGURES

FIGS. 3*a* and FIG. 3*b* is a top view and a side view of a pointed wheel utilized as the element for the generation of pulses of FIG. 2;

FIGS. 4*a* and 4*b* is a top view and a side view of a toothed wheel utilized as the element for the generation of pulses of FIG. 2;

FIG. 5 is a top view of juxtaposed wheels utilized as the elements for the generation of pulses of FIG. 2;

FIG. 9*a*–9*c* is a schematic view of the rotary cylinder similar to FIG. 2, showing a second embodiment of resiliently held protuberances in top views and a partly sectioned side view;

DETAILED DESCRIPTION OF PREFERRED EMBODIMENTS

The features described in the following with reference to FIGS. 1 to 14 are suitable for use with an epilating appliance as disclosed in European Offenlegungsschrift (Published Application) No. 596 283 A1 and as it is herewith incorporated in the disclosure content of the present patent application by express reference.

This Patent Application describes an epilating appliance for the epilation of the human skin, having a rotary cylinder which is rotatably mounted in a housing and can be driven by an in particular electric motor. The rotary cylinder has a plurality of clamping devices which in the activated operating condition perform a rotary movement together with the rotary cylinder, cyclically entrapping and extracting those hairs of the user's skin that are turned toward them.

Figure 1:
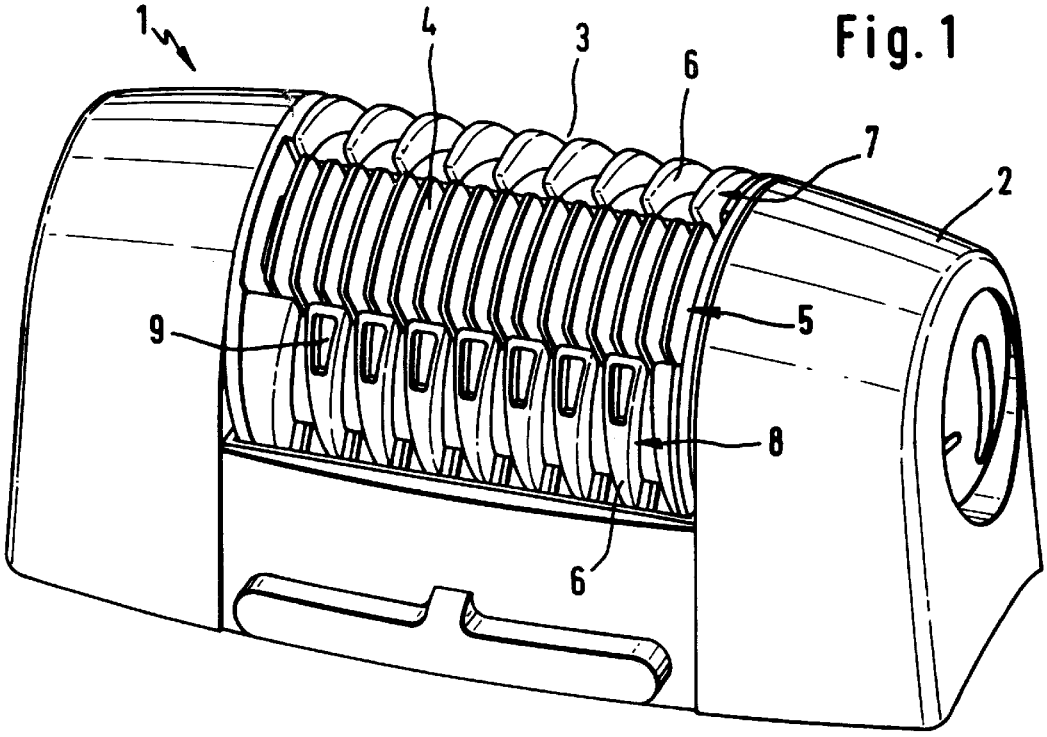
FIG. 1 is a schematic perspective view of an epilation head of an embodiment of an epilating appliance of the present invention.

FIG. 1 shows an epilation head 1 of an epilating appliance of the present invention. This head has a housing 2 in which there is an opening 3 that can be turned to face the user's skin. Inside the opening 3 are a plurality of clamping devices 4 which project out through the housing 2. The clamping devices 4 are arranged side by side in a row 5. On either side of this row 5 are a plurality of threading devices 6 which are arranged likewise in a row 7, 8 and project out through the opening 3. Each threading device 6 has an opening 9 through which an element for generating a pulse to be described in the following can protrude.

As becomes apparent from European Patent Application No. 596 283 A1 and as will be described below at least in part, the epilation head 1 shown in FIG. 1 can have not just a single row 5 of clamping devices 4 but several such rows. The same applies for the rows 7, 8 of threading devices 6, the number of rows of clamping devices 4 normally corresponding to the number of rows of threading devices 6.

Figure 2:
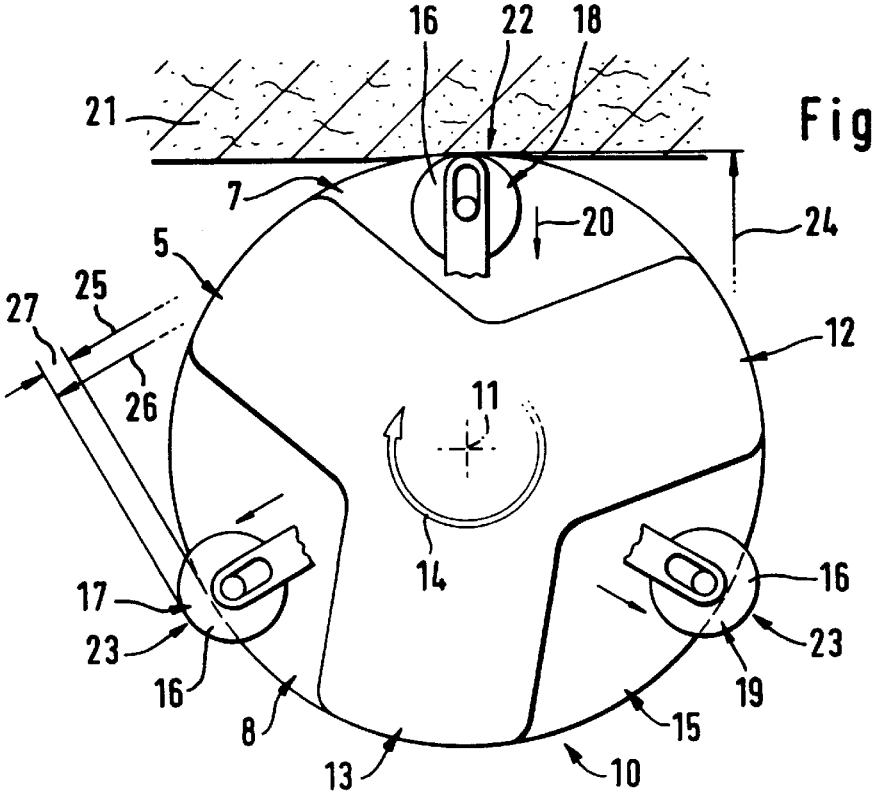
FIG. 2 is a schematic sectional view of a rotary cylinder for the epilation head of FIG. 1, showing clamping devices and elements for the generation of pulses.

FIG. 2 shows a rotary cylinder 10 which is mounted in the housing 2 of the epilation head 1 for rotation about an axis 11. The rotary cylinder 10 has three rows 5, 12, 13 of clamping devices 4, which are arranged symmetrically in the direction of rotation 14 and project from the axis 11 in radial direction. Three rows 7, 8, 15 of threading devices 6, which looking from above are arranged between the rows 5, 12, 13 of clamping devices 4, are also provided.

Approximately between each of the three rows 5, 12, 13 of clamping devices 4 there is a single element 16 for generating pulses or a row 17, 18, 19 of elements 16 for generating pulses. The elements 16 are coupled with the rotary cylinder 10, performing the rotary movement of the rotary cylinder about the axis 11 in the direction of rotation 14. The elements 16 are arranged on the inside of the threading devices 6 and are able to project out through the openings 9 of the threading devices 6. Each element 16 is arranged directly in front of the next succeeding clamping device 4 viewed in the direction of rotation 14. Each element 16 is coupled with the rotary cylinder 10 in such a way as to be movable in a reciprocating motion in a straight line or curve in a direction 20 arranged essentially radial to the axis 11. Hence each element 16 is movable approximately in the direction 20 toward and away from the skin 21 as soon as it is turned roughly toward the skin 21.

This reciprocating movement of the element 16 includes a retracted position 22 and an advanced position 23, with the direction of movement being reversed each time a limit point is reached. In a rotary movement of the rotary cylinder 10 and hence of the elements 16, the outermost diameter 24 traversed by the elements 16 in their retracted position 22 is smaller than or equal to the maximum diameter 25 of the clamping devices 4. Similarly the diameter 26 traversed by the elements 16 in their advanced position 23 is greater than the maximum diameter 25 of the clamping devices 4. The diameter 26 traversed in the advanced position 23 exceeds the maximum diameter 25 of the clamping devices 4 by a value 27 of about 0.1 mm to about 6 mm.

With the epilating appliance switched on, the element 16 produces a mechanical pulse on the skin 21 in the form of a jolt or prick. Due to the arrangement of the element 16 directly in front of its related clamping device 4 viewed in the direction of rotation 14, the pulse is delivered to the skin 21 directly ahead of the time and place of the epilation by the clamping device 4. With the assignment of exactly one element 16 to one clamping device 4, a pulse is delivered before each individual epilating operation. The generation of a pulse by the respective element 16 takes place once only for each individual clamping device 4 and each clamping operation.

To generate the pulse the element 16 in its advanced position 23 strikes the skin 21, delivering as this occurs the pulse to the skin 21. Directly upon striking the skin 21 the element 16 is returned to its retracted position 22 at least as long as the element 16 is no longer opposite or in engagement with the skin 21. This is shown in FIG. 2.

Where applicable, the element 16 can be made to recede to its retracted position 22 in that the element 16 is urged back by the skin 21 itself, for example, against the force of a spring or against the centrifugal force or the like. This is explained in the following in greater detail with reference to FIGS. 5 and 6.

Provided the element 16 protrudes in its advanced position 23 by only a small degree or marginally beyond the maximum diameter 25 of the clamping device 4, it may be possible in certain cases to dispense completely with moving the element 16 to its retracted position 22.

Alternatively it is possible for the element 16 to be moved from its retracted position 22 into its advanced position 23 directly before epilation. This represents a movement of the element 16 in the direction 20 toward the skin 21, whereby a pulse is delivered by the element 16 to the skin 21. Directly after the pulse is delivered the element 16 is moved back into its retracted position 23 and hence away from the skin 21. This reciprocating movement of the element 16 can be generated by suitable cam tracks, for example, which act on the element 16. This is explained below in closer detail with reference to FIG. 7.

Various embodiments of the element 16 are shown in the FIGS. 3*a, b* and 4*a, b*. It is possible, for example, for the element 16 to be constructed as a wheel 28 that has a point 29 on its circumference. In addition and/or alternatively, the wheel 28 can be constructed to include a plurality of teeth 30 whose free ends may be equipped with the points 29. Further embodiments consist of correspondingly constructed rollers or the like. The diameter of the wheel 28 or the roller is conventionally significantly smaller than the maximum diameter 25 of the clamping device 4.

Figure 6:
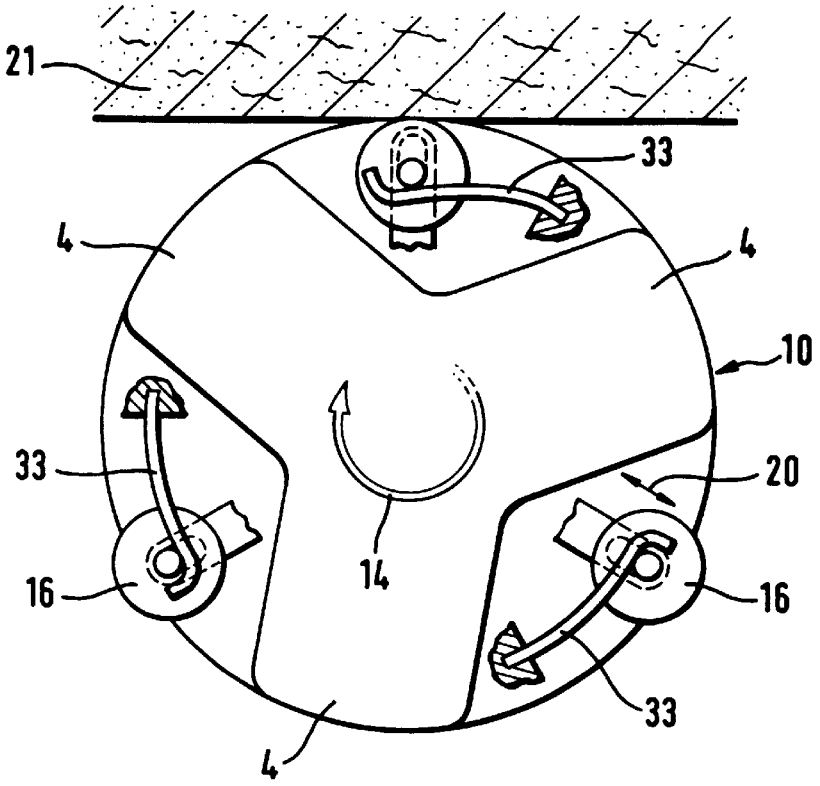
FIG. 6 is a schematic sectional view of the rotary cylinder of FIG. 2, including springs for moving the elements for the generation of pulses.
Figure 7:
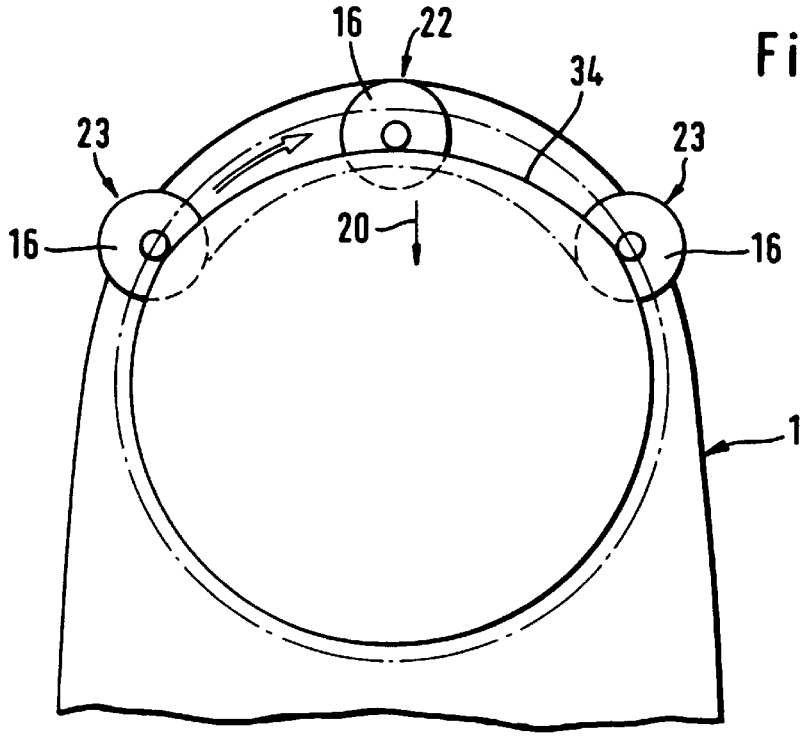
FIG. 7 is a schematic sectional view of the rotary cylinder of FIG. 2, including cam tracks for moving the elements for the generation of pulses.

Various embodiments for generating the reciprocating movements of the element 16 are shown in FIGS. 5 to 7.

According to FIGS. 5 or 6, it is thus possible for a single element 16 or a plurality of elements arranged, for example, in row form on a shaft 31 to be connected to the rotary cylinder 10 via springs 32, 33. Consequently, the elements 16 are urged into their advanced position 23 by spring force during a rotary movement of the rotary cylinder 10 about the axis 11. As a result of the elements 16 striking the skin 21, the elements 16 are urged back against the force of the springs 32, 33 approximately parallel to the direction 20 into their retracted position 22 until the elements 16 are no longer opposite the skin 21 on account of the rotary movement.

In this arrangement, the spiral springs 32 in the embodiment of FIG. 5 are arranged approximately parallel to the direction 20 while the leaf springs 33 in the embodiment of FIG. 6 are arranged approximately transverse to the direction 20. In both embodiments the spring force of the springs 32, 33 acts radially outward approximately parallel to the direction 20 so that the elements 16 are always urged outward by the springs 32, 33 approximately parallel to the direction 20 into the advanced position 23.

In addition and/or alternatively, it is possible in accordance with FIG. 7 to provide a cam track 34 with which the element 16 is coupled and by means of which the reciprocating movement of the element 16 is controlled. The cam track 34 results in the element 16 being moved approximately parallel to the direction 20 into the advanced position 23 directly before epilation. This occurs approximately when the element 16 is roughly opposite the skin 21. Preferably the element 16 is moved into the advanced position 23 as quickly or suddenly as possible by a suitable construction of the cam track 34. After the pulse is delivered the element 16 is moved back into its retracted position 22 by a suitable construction of the cam track 34.

Other embodiments of the element 16 become apparent from FIGS. 8*a–c* and 9*a–c*.

Figures 8, 8A, 8B, 8C:
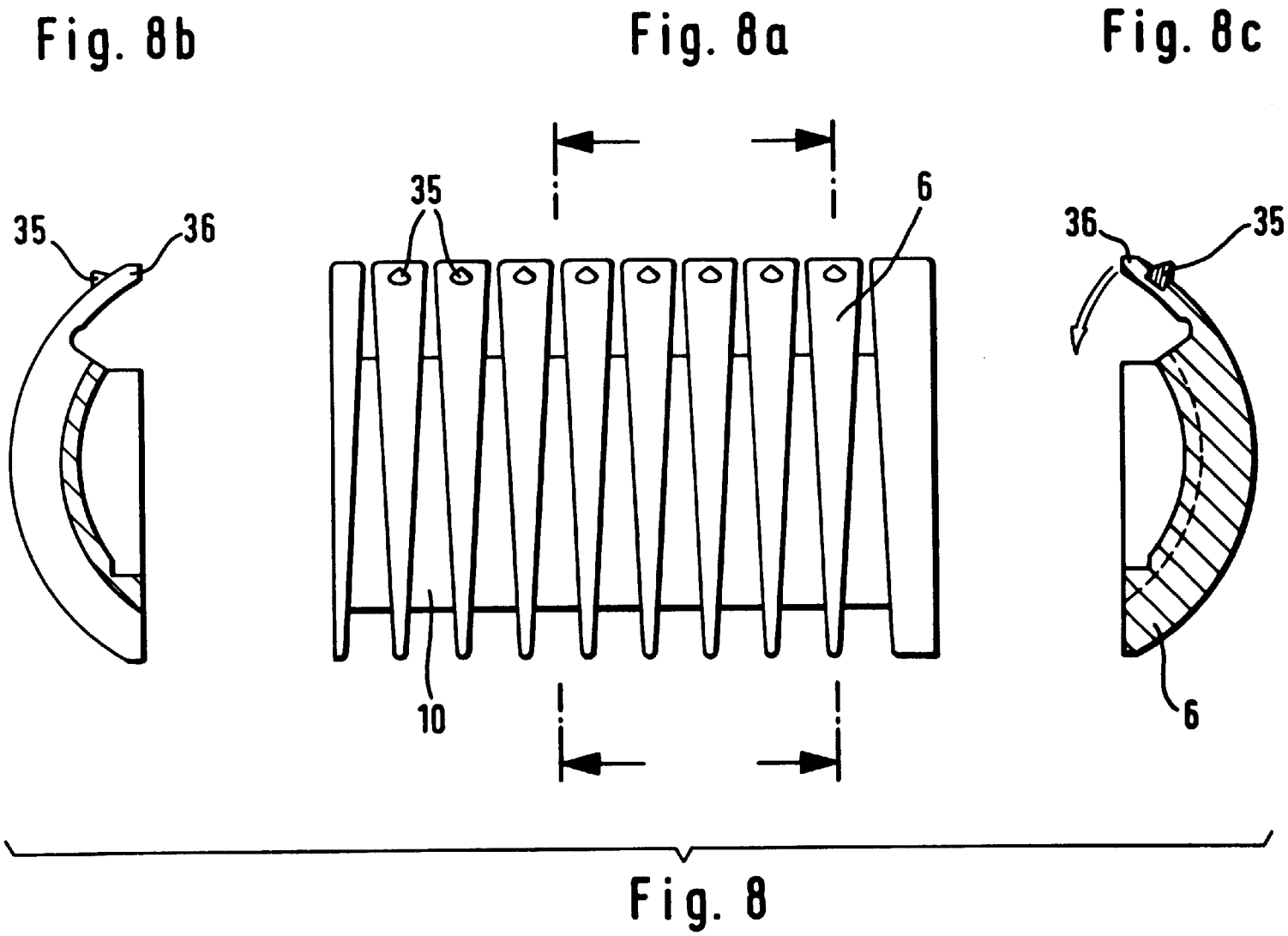
FIGS. 8*a*–8*c* is a schematic view of the rotary cylinder similar to FIG. 2, showing a first embodiment of resiliently held protuberances in a top view and partly sectioned side views.
Figure 10:
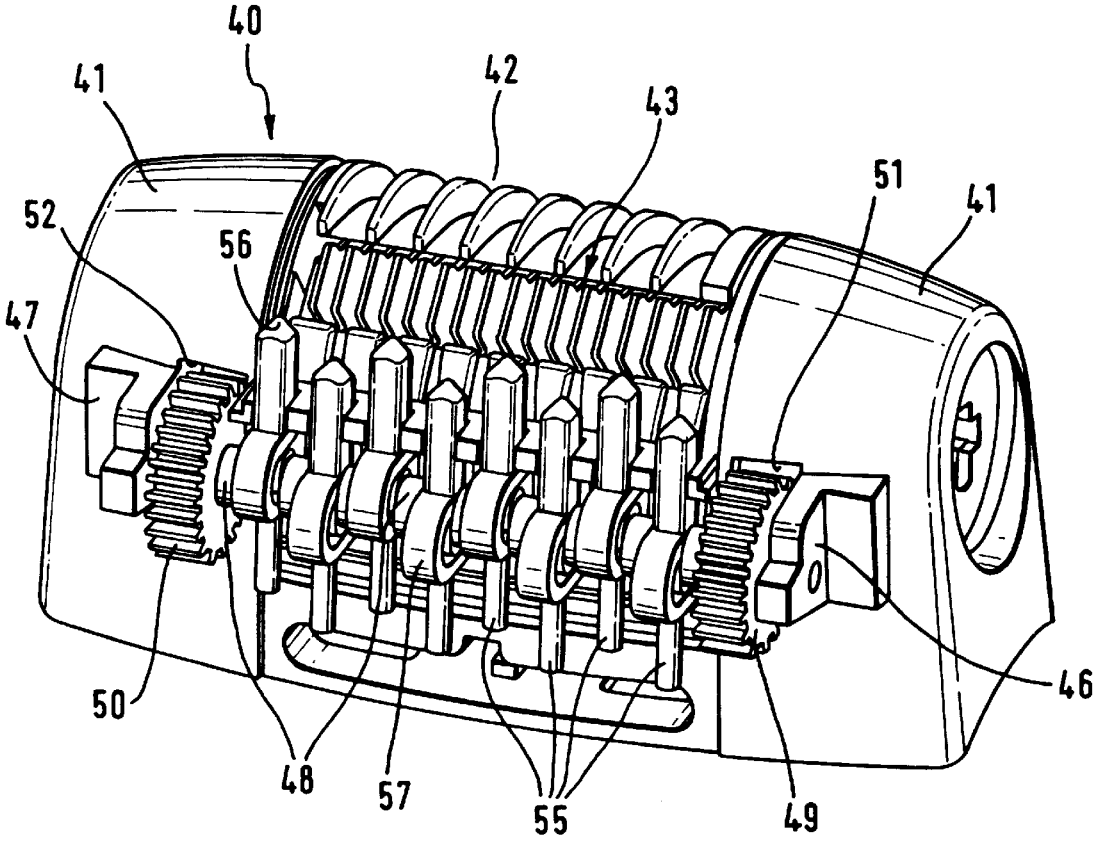
FIG. 10 is a schematic perspective view of an epilation head of a further embodiment of an epilating appliance of the present invention.
Figure 11:
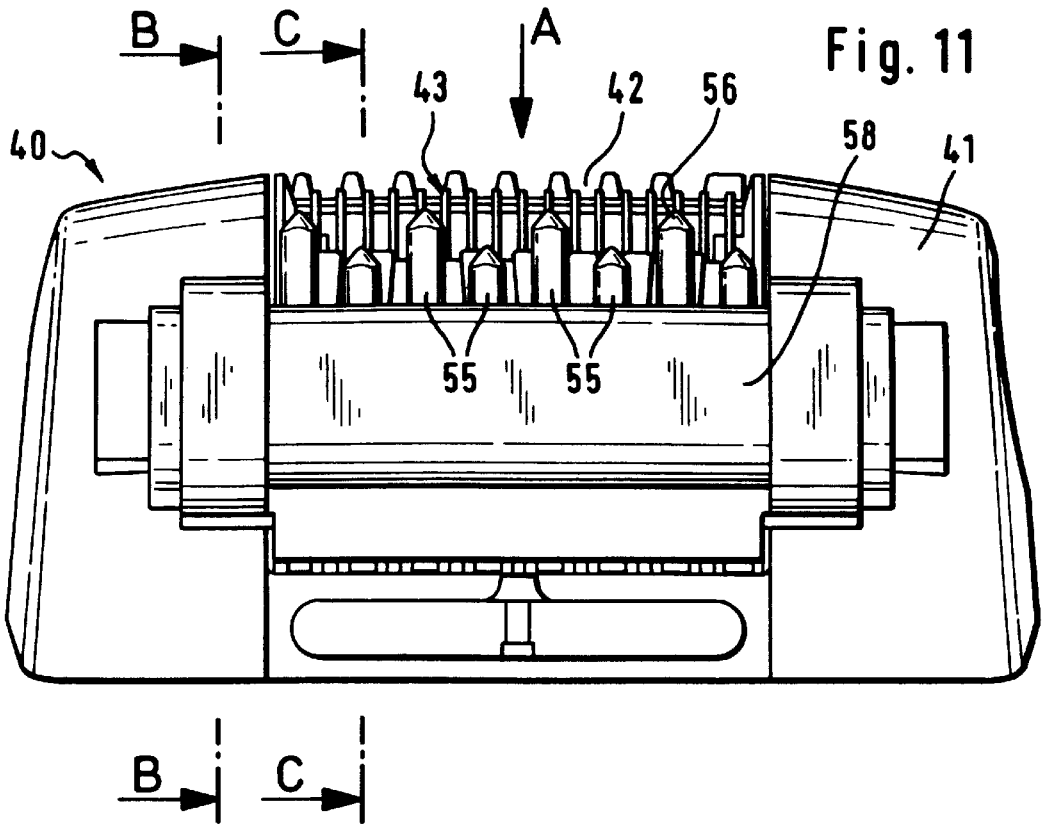
FIG. 11 is a schematic side view of the epilation head of FIG. 10, viewed in the direction D of FIG. 12.
Figure 12:
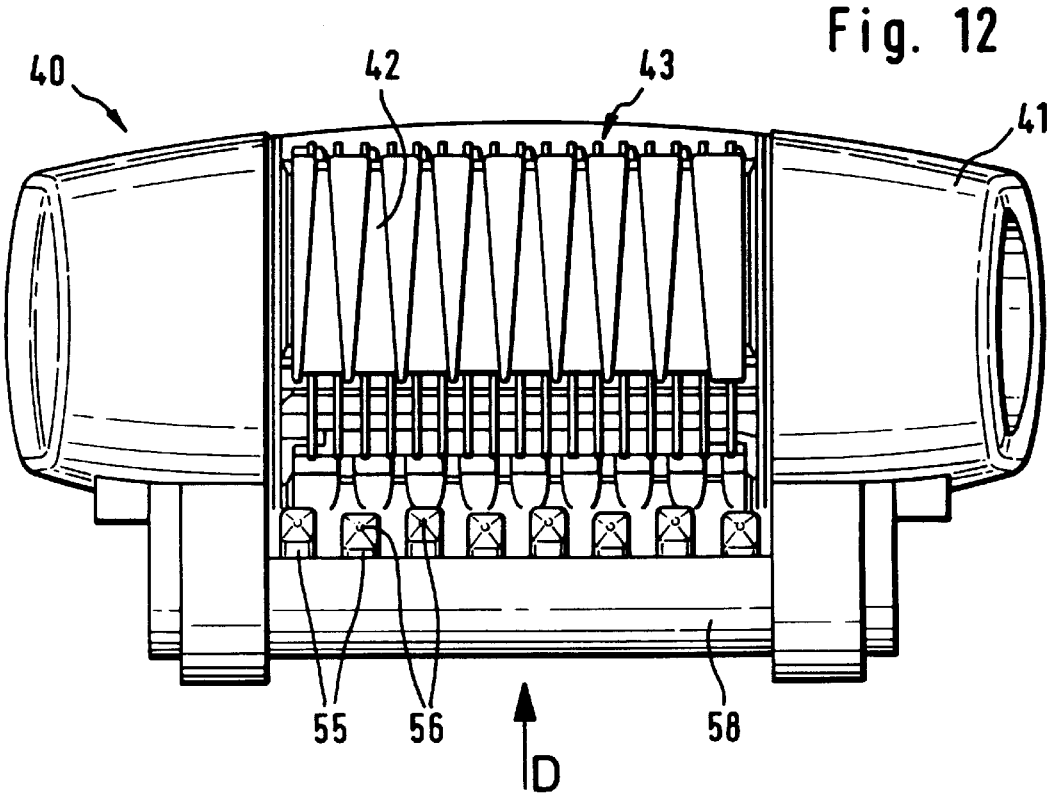
FIG. 12 is a schematic top view of the epilation head of FIG. 10, viewed in the direction A of FIG. 11.
Figure 13:
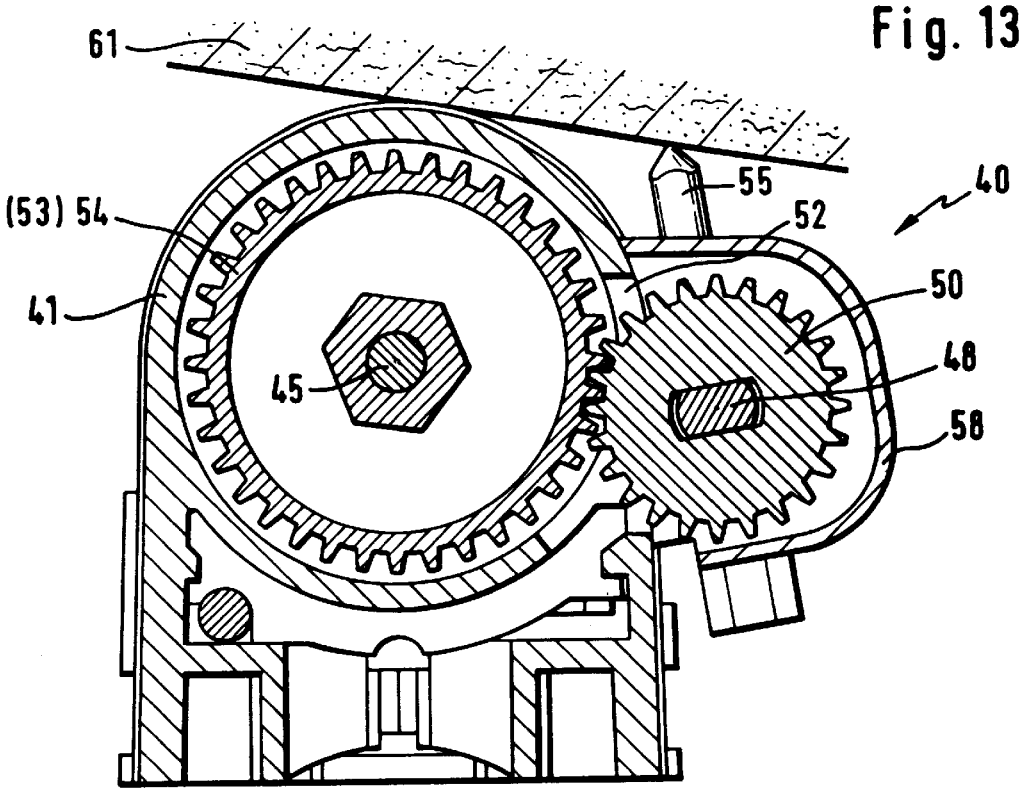
FIG. 13 is a schematic sectional view of the epilation head of FIG. 10, taken along the plane B—B of FIG. 11.
Figure 14:
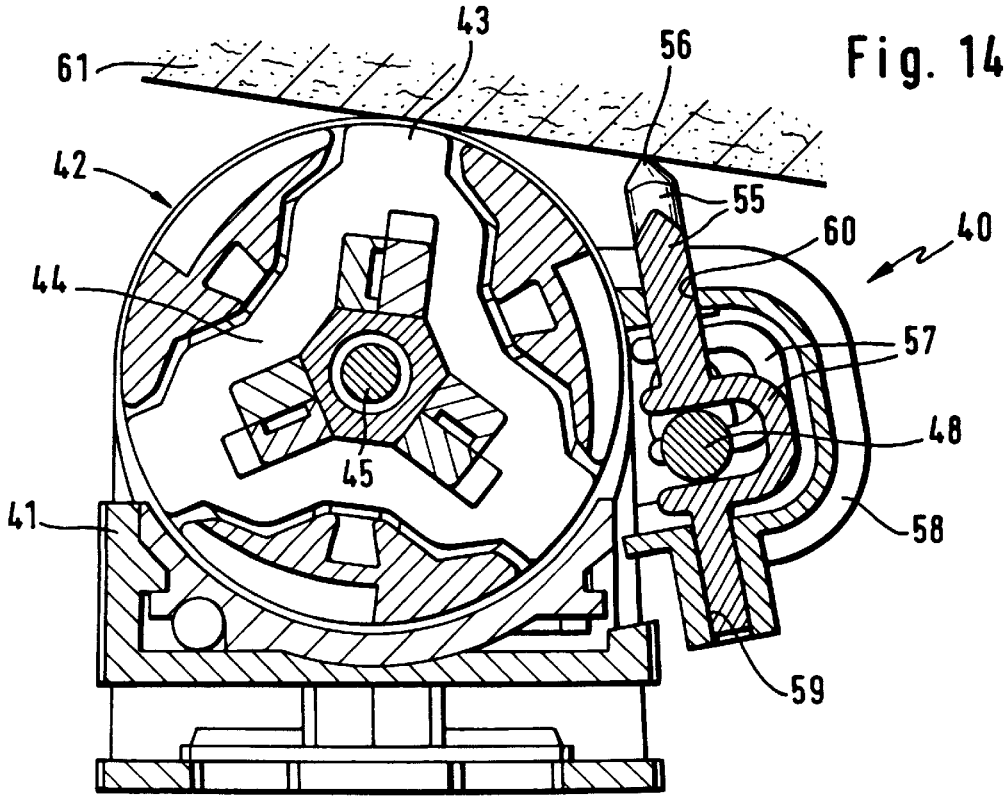
FIG. 14 is a schematic sectional view of the epilation head of FIG. 10, taken along the plane C—C of FIG. 11.

According to FIGS. 8*a, b, c* it is thus possible for the element 16 to be configured as a protuberance 35 that is positioned on the free end 36 of a threading device 6 and hence connected to the rotary cylinder 10. In this embodiment, at least the free end 36 of the threading device 6 is of a resilient configuration, for example by being made of a plastic material. In the normal state the protuberance 35 adopts the advanced position 23. Upon contact with the skin 21 the protuberance 35 is urged back by the skin 21 itself against the resilient force into the retracted position 22. Once the protuberance 35 is no longer opposite the skin 21 it is urged forward again by the resilient force into the advanced position 23.

Alternatively it is possible in accordance with FIGS. 9*a, b, c* for the element 16 to be constructed not as a protuberance 35 but as a point 37, with bars 39 interconnecting the various points, and each point extends in radial direction through the opening 9 of the threading device 6 and is connected to the threading device 6 or other components of the rotary cylinder 10 via a resilient arm 38. The arm 38 can be made of spring steel or a plastic material.

FIGS. 10 to 14 show an epilation head 40 for an epilating appliance as described initially with reference to European Patent Application No. 596 283 A1. The epilation head 40 has a housing 41 with an opening 42 that can be turned to face the user's skin. A plurality of clamping devices 43 are inside the opening 42 and project out through the housing 41. The clamping devices 43 are arranged side by side in a row. As described in European Patent Application No. 596 283 A1, it is possible for the epilation head 40 shown in FIGS. 10 to 14 to have not only a single row of clamping devices 43 but several such rows. For this case, as becomes apparent in particular from FIG. 14, the clamping devices 43 form a rotary cylinder 44 which is mounted in the housing 41 of the epilation head 40 for rotation about an axis 45.

Two bearing blocks 46, 47 in which the ends of a drive shaft 48 are rotatably mounted are secured to the housing 41 of the epilation head 40. The drive shaft 48 is arranged approximately parallel to the clamping devices 43 and hence approximately parallel to the axis 45 of the rotary cylinder 44.

The drive shaft 48 carries one gear wheel 49, 50 directly next to each of the two bearing blocks 46, 47. The gear wheels 49, 50 are non-rotatably fixed to the drive shaft 48, projecting through openings 51, 52 in the housing 41 into the interior of the epilation head 40. Here the gear wheels 49, 50 are each in meshing engagement with a cooperating toothed flange 53, 54 non-rotatably connected to the rotary cylinder 44 and hence to the clamping devices 43. This becomes apparent in particular from FIG. 13.

The drive shaft 48 is configured in the manner of a crank and hence has non-axial components. In particular the drive shaft is formed by a crankshaft on the ends of which the gear wheels 49, 50 are positioned as already described.

At least one element 55 is associated with the drive shaft 48. In the present embodiment of FIGS. 10 to 14 a total of eight elements 55 are associated with the drive shaft 48. Each of the elements 55 has a ram-type, longitudinal appearance with a point 56 on a free end. In approximately middle position each of the elements 55 has a guide 57 of a U-shaped configuration. The non-axial components of the drive shaft 48 engage in these guides 57.

The individual elements 55 are arranged approximately parallel to each other. In relation to the housing 41 the elements 55 are also approximately parallel to the housing's outer side. The points 56 of the elements 55 are arranged on the same side as the opening 42 in the housing 41. The points 56 thus face the user's skin when the epilating appliance is in use. The arrangement and the length of the elements 55 are selected so that the points 56 of the elements 55 form approximately just about one plane with the clamping devices 43 of the epilation head 40 during use, thus enabling the points 56 to just about touch the user's skin. This becomes apparent in particular from FIGS. 13 and 14.

The drive shaft 48, the gear wheels 49, 50 and the areas of the guides 57 of the elements 55 are accommodated under a cover 58 secured to the housing 41. In the cover 58 are bores 59, 60 in which the elements 55 are slidably guided on either side of the guides 57.

With the epilating appliance switched on, the rotary cylinder 44 performs a rotary movement about the axis 45. The rotary movement is transmitted to the drive shaft 48 via the toothed flange 53, 54 and the mating gear wheel 49, 50. The elements 55 are made to move up and down by the non-axial components of the drive shaft 48 and the guides 57.

This movement occurs essentially in a straight line, proceeding approximately in the longitudinal direction of the elements 55. The movement is oriented approximately transverse to the user's skin 61. This becomes apparent in particular from FIGS. 13 and 14.

Due to an offset arrangement of the non-axial components of the drive shaft 48 it is possible to make the elements 55 perform mutually opposing up and down movements. This becomes apparent in particular from FIG. 10.

The speed of the up and down movement of the elements 55 can be set by the numbers of teeth of the toothed flange 53, 54 and the gear wheel 49, 50. The frequency of the up and down movement of the elements 55 preferably equals 30 hertz, approximately. It is also possible, however, for the frequency to be higher or lower.

Due to the arrangement of the elements 55 on the housing 41, the up and down movement causes the points 56 of the elements 55 to land straight on the skin 61 when the epilation head 40 is placed on the skin 61. This becomes apparent in particular from FIGS. 13 and 14.

The mechanical control of the elements 55 by means of the drive shaft 48 is configured in such a way that the points 56 of the elements 55 are lowered onto the skin 61 and hence strike the skin 61 directly before or during epilation by the clamping device 43. A mechanical pulse thus acts on the skin 61, producing an artificial pain that overshadows and consequently reduces the actual pain caused by the epilation. Further the control is configured in such a way that the points 56 of the elements 55 are lifted off the skin 61 again directly after striking it.

We claim:

1. A depilation appliance for plucking hair of the human skin of a user, comprising a housing having an opening defining a plucking zone, a rotary depilation member comprising a plurality of hair-grasping elements, said depilation member disposed within the opening and rotating about its axis for grasping hairs of the skin of the user within the plucking zone, an impulse generator comprising a plurality of reciprocating skin-impacting impulse elements disposed adjacent the plurality of hair grasping elements, and a motor drive element disposed within the housing coupled with the depilation member and to drive the impulse generator, and wherein each of said plurality of reciprocating skin-impacting impulse elements has a distal free end, each of said plurality of free ends cyclically being accelerated into and subsequently away from the skin to impart a localized impulse stimulus perceived by the nervous system of the user in synchronization with a rotational cycle of the depilation member, whereby each said impulse element free end imparts a masking stimulus approximately coincident with an adjacent hair-grasping element plucking the hair of the user during the rotational cycle, to thereby lessen a perceived discomfort of depilation.

2. A depilation appliance according to claim 1, wherein the plurality of skin-impacting impulse elements is disposed on the rotary depilation member, whereby a portion of the plurality of free ends simultaneously moves generally towards and away from said plucking zone while being accelerated into and subsequently away from the skin.

3. A depilation appliance according to claim 1, wherein the plurality of skin-impacting impulse elements is mounted in at least one row.

4. A depilation appliance according to claim 3, wherein the at least one row of skin-impacting impulse elements is generally parallel to the rotational axis of the rotary depilation member.

5. A depilation appliance according to claim 3, wherein the at least one row of skin-impacting impulse elements is generally parallel to an exterior surface of the housing.

6. A depilation appliance according to claim 3, wherein the at least one row of skin-impacting impulse elements is outside of and adjacent the opening in the housing.

7. A depilation appliance according to claim 1, wherein the skin-impacting impulse elements are of pin-shaped configuration and whose free ends are pointed.

8. A depilation appliance according to claim 1, wherein a portion of the plurality of skin-impacting impulse elements have their free ends disposed during depilation intersecting a plane constructed tangent to the hair-grasping elements, whereby the free ends of the portion contact the skin straight.

9. A depilation appliance according to claim 1, wherein the skin-impacting impulse elements are of pin-shaped configuration moving during depilation generally perpendicular to a surface of the skin.

10. A depilation appliance according to claim 1, wherein the skin-impacting impulse elements are displaced generally linearly during depilation parallel to their longitudinal axes.

11. A depilation appliance according to claim 1, wherein the distal free ends of the skin-impacting impulse elements have portions adjacent their free edges at least partially formed with a tapered shape selected from a group of shapes consisting of pyramids and cones.

12. A depilation appliance according to claim 1, wherein the plurality of hair-grasping elements cyclically open and close during rotation of the depilation member, and the plurality of skin-impacting impulse elements is coupled to the rotary depilation member.

13. A depilation appliance according to claim 1, wherein the plurality of skin-impacting impulse elements moves in response to a spring.

14. A depilation appliance according to claim 1, wherein the plurality of skin-impacting impulse elements moves in response to a cam surface.

15. A depilation appliance according to claim 1, wherein the free ends of the plurality of skin-impacting impulse elements move towards the skin no later than a time in which the adjacent hair-grasping element plucks the hair and said free ends subsequently move away from the skin immediately after imparting the localized impulse stimulus.

16. A depilation appliance according to claim 1, wherein the plurality of skin-impacting impulse elements is driven by a mechanical linkage disposed between the impulse elements and the motor towards and away from the skin.

17. A depilation appliance according to claim 1, wherein the impulse generator further comprises a drive shaft coupled to the plurality of skin-impacting impulse elements.

18. A depilation appliance according to claim 17, wherein the impulse generator drive shaft is formed as a crankshaft.

19. A depilation appliance according to claim 17, wherein the respective skin-impacting impulse elements further comprise a guide slot in which the drive shaft is disposed.

20. A depilation appliance according to claim 17, wherein the impulse generator drive shaft is coupled to the rotary depilation member by a transmission member.

21. A depilation appliance according to claim 20, wherein the transmission member comprises gears selected from a group of gears consisting of spur gears and bevel gears.

22. A depilation appliance according to claim 17, wherein the impulse generator drive shaft is disposed substantially parallel to the rotational axis of the depilation member.

23. A depilation appliance according to claim 1, wherein a first portion of the distal free ends is accelerated towards the skin while a second portion of the distal free ends is accelerated away from the skin.

24. A depilation appliance according to claim 1, wherein the distal free ends are accelerated in unison towards and away from the skin.

25. A depilation appliance according to claim 1, wherein the plurality of impulse element free ends traverse the plucking zone during rotation of the rotary depilation member.

26. A depilation appliance according to claim 1, wherein the plurality of skin-impacting impulse elements is mounted on an outside lateral surface of the appliance housing, whereby said impulse element free ends impart masking stimuli to a region of the skin prior to said region being traversed by the plucking zone and being subjected to the hair-grasping elements plucking the hair of the user as the user moves the depilation appliance over the skin.

27. A depilation appliance according to claim 1, wherein each of the impulse elements has a base portion located remote from the distal free end thereof and away from the skin, said base portion being proximal the depilation member rotational axis.

28. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising a plurality of reciprocating skin-impacting impulse elements disposed in laterally spaced relation to the plucking zone, and a motor drive element disposed within the housing coupled with the depilation member and to drive the impulse generator, and wherein each of said reciprocating skin-impacting impulse elements has a distal free end cyclically being accelerated into and subsequently away from a region of skin to impart localized impulse stimulus perceived by the nervous system of the user in synchronization with a rotational cycle of the depilation member, whereby each said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

29. A depilation appliance according to claim 28, wherein a first portion of the distal free ends is accelerated towards the skin while a second portion of the distal free ends is accelerated away from the skin.

30. A depilation appliance according to claim 28, wherein the distal free ends are accelerated in unison towards and away from the skin.

31. A depilation appliance according to claim 28, wherein the plurality of impulse elements is disposed outside the housing opening.

32. A depilation appliance according to claim 28, wherein the plurality of skin-impacting elements is mounted on an outside lateral surface of the appliance housing, whereby the plurality of elements impart localized impulse stimuli to the skin outside the plucking zone.

33. A depilation appliance according to claim 28, wherein the plurality of skin-impacting impulse elements is mounted in at least one row.

34. A depilation appliance according to claim 33, wherein the at least one row of skin-impacting impulse elements is generally parallel to the rotational axis of the rotary depilation member.

35. A depilation appliance according to claim 33, wherein the at least one row of skin-impacting impulse elements is generally parallel to an exterior surface of the housing.

36. A depilation appliance according to claim 28, wherein a portion of the plurality of skin-impacting impulse elements have their free ends disposed during depilation intersecting a plane constructed tangent to peripheral edges of the hair-grasping elements.

37. A depilation appliance according to claim 28, wherein the skin-impacting impulse elements move during depilation generally perpendicular to a surface of the skin.

38. A depilation appliance according to claim 28, wherein the skin-impacting impulse elements displace during depilation while maintaining an orientation generally parallel their longitudinal axes in the rest position.

39. A depilation appliance according to claim 38, wherein the skin-impacting impulse elements displace generally linearly parallel their longitudinal axes.

40. A depilation appliance according to claim 28, wherein the distal free ends of the skin-impacting impulse elements have portions adjacent their free edges at least partially formed with a tapered shape selected from a group of shapes consisting of pyramids and cones.

41. A depilation appliance according to claim 28, wherein the free ends of the plurality of skin-impacting impulse elements move towards the skin generally coincident with adjacent hair-grasping elements plucking the hair and said free ends subsequently move away from the skin immediately after imparting the localized impulse stimulus.

42. A depilation appliance according to claim 28, wherein the plurality of impulse elements is disposed in spaced relation to the depilation member.

43. A depilation appliance according to claim 1 or 28, the skin-impacting impulse elements being substantially rigid.

44. A depilation appliance according to claim 1 or 28, wherein the depilation member is generally cylindrical.

45. A depilation appliance according to claim 1 or 28, wherein the depilation member is generally right circular cylindrical.

46. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the impulse element is disposed in the rotary depilation member, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

47. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the impulse element free end traverses the plucking zone during rotation of the rotary depilation member, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

48. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the skin-impacting impulse element is of pin-shaped configuration, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

49. A depilation appliance for plucking hair of the human skin of a user, comprising a housing having an opening, a rotary depilation member having an outer envelope surface and comprising a plurality of hair-grasping elements said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the skin-impacting impulse element is biased by a spring, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

50. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the skin-impacting impulse element moves in response to a cam surface, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

51. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the impulse generator further comprises a drive shaft coupled to the skin-impacting impulse element, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

52. A depilation appliance according to claim 51, wherein the impulse generator drive shaft is formed as a crankshaft.

53. A depilation appliance according to claim 51, wherein the impulse generator drive shaft is coupled to the rotary depilation member by a transmission member.

54. A depilation appliance according to claim 53, wherein the transmission member comprises linkage elements engaging in rolling contact.

55. A depilation appliance according to claim 53, wherein the transmission member comprises gears.

56. A depilation appliance according to claim 53, wherein the impulse generator drive shaft is disposed substantially parallel to the rotational axis of the depilation member.

57. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a plurality of distal free ends cyclically being accelerated into and subsequently away from a region of skin to impart localized impulse stimulus perceived by the nervous system of the user in synchronization with a rotational cycle of the depilation member, whereby each said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

58. A depilation method for reducing a perceived discomfort to a user during depilation, comprising the steps of providing a depilation member having hair-grasping elements and a rotary axis coupled to a drive element, providing at least one skin-impacting element driven by said drive element and disposed in spaced relation to the hair-grasping elements, said skin-impacting element having a plurality of distal free ends, gripping and pulling hairs from the skin of the user by rotating the depilation member, accelerating said distal free ends into and out of contact with the skin, imparting a mechanical impulse stimulus to the skin by each said distal free end approximately coincident in time with the step of gripping and pulling, whereby the impulse stimulus imparted to the skin masks the discomfort of depilation.

59. A depilation method according to claim 55, wherein the skin-impacting element is provided with a plurality of projections having said distal free ends for impacting the skin.

60. A depilation method for reducing a perceived discomfort to a user during depilation, comprising the steps of providing a depilation member having a rotary axis coupled to a drive element, providing a plurality of skin-impacting distal free ends driven by said drive element, gripping and pulling hairs from the skin of the user by rotating the depilation member, imparting a plurality of localized mechanical impulse stimuli to the skin by said plurality of distal free ends approximately coincident in time with the step of gripping and pulling, whereby the plurality of imparted localized impulse stimuli mask the discomfort of depilation.

61. A depilation method according to claim 55 or 60, wherein the step of imparting comprises the distal free ends moving generally linearly.

62. A depilation method according to claim 55 or 60, wherein the step of gripping and pulling hairs comprises pulling a hair from a region of skin after the step of imparting stimulates said region of skin.

63. A depilation method according to claim 55 or 60, wherein the depilation member is moved in a first direction over the skin and the step of imparting imparts the impulse immediately prior to depilation in said first direction.

64. A depilation method according to claim 60, wherein the plurality of skin-impacting distal free ends is disposed spaced from the depilation member rotary axis and extending along a generally similar direction as the depilation member rotary axis.

65. A depilation appliance for plucking hair of the human skin of a user, comprising a housing having an opening, a rotary depilation member having an outer envelope surface and comprising a plurality of hair-grasping elements, said hair-grasping elements sequentially clamping and opening respectively into and out of hair plucking relation to one another, said depilation member disposed within the opening and rotating about its axis for grasping hairs of the skin of the user within a plucking zone defined by a region of intersection of clamped hair-grasping element portions with the outer envelope surface, an impulse generator comprising at least one reciprocating skin-impacting impulse element disposed in laterally spaced relation to the plucking zone, and a motor drive element disposed within the housing coupled with the depilation member and to drive the impulse generator, and wherein said reciprocating skin-impacting impulse element has a distal free end cyclically being accelerated into and subsequently away from a region of skin to impart localized impulse stimulus perceived by the nervous system of the user in synchronization with a rotational cycle of the depilation member, and wherein the skin-impacting impulse element is of disc-shaped configuration in a region of the free end, whereby said impulse element free end imparts a masking stimulus to the region of the skin in sequence with the skin being subjected to the hair-grasping elements plucking the hair of the user as the user moves the depilation appliance over the skin, to thereby lessen a perceived discomfort of depilation.

* * * * *

IN THE UNITED STATES PATENT AND TRADEMARK OFFICE

CERTIFICATE OF CORRECTION

PATENT NO.: 6,083,233

DATED: July 4, 2000

INVENTOR(S): Kreutz et al.

Assistant Commissioner for Patents
Washington, DC 20231

It is certified that error appears in the above-identified patent and that said Letters Patent is hereby corrected as shown below:

Column 15, line 45 (Claim 49), after "elements" insert --,-- ;

column 17, line 17 (Claim 56), change "claim 53" to --claim 51-- ;

column 17, line 64 (Claim 59), change "claim 55" to --claim 58-- ;

column 18, line 16 (Claim 61), change "claim 55" to --claim 58-- ;

column 18, line 19 (Claim 62), change "claim 55" to --claim 58-- ; and column 18, line 23 (Claim 63), change "claim 55" to --claim 58-- .

Signed and Sealed this

Seventeenth Day of April, 2001

*Attest:*

Nicholas P. Godici

NICHOLAS P. GODICI

*Attesting Officer*

*Acting Director of the United States Patent and Trademark Office*